US008152162B2

(12) United States Patent
Obuchi

(10) Patent No.: US 8,152,162 B2
(45) Date of Patent: Apr. 10, 2012

(54) SHEET STACKING APPARATUS AND IMAGE FORMING APPARATUS

(75) Inventor: Yusuke Obuchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 180 days.

(21) Appl. No.: 12/641,607

(22) Filed: Dec. 18, 2009

(65) Prior Publication Data

US 2010/0164162 A1 Jul. 1, 2010

(30) Foreign Application Priority Data

Dec. 26, 2008 (JP) ..... 2008-334039
Dec. 16, 2009 (JP) ..... 2009-284854

(51) Int. Cl.
*B65H 43/04* (2006.01)

(52) U.S. Cl. ..... 271/198; 271/199; 271/202; 271/204

(58) Field of Classification Search ..... 271/176, 271/198, 199, 202–204
See application file for complete search history.

(56) References Cited

U.S. PATENT DOCUMENTS 5,649,483 A * 7/1997 Mack et al. ..... 101/232
5,671,920 A * 9/1997 Acquaviva et al. ..... 271/307
6,641,133 B2 11/2003 Mutschall et al. ..... 271/204
7,192,020 B2 3/2007 Hayashi et al.
7,264,236 B2 9/2007 Obuchi et al.
7,354,036 B2 4/2008 Hayashi et al.
7,401,776 B2 7/2008 Obuchi et al.
7,431,273 B2 10/2008 Kamiya et al.
7,445,207 B2 11/2008 Obuchi et al.
7,552,917 B2 6/2009 Hayashi et al.
2007/0075479 A1 4/2007 Obuchi et al.

FOREIGN PATENT DOCUMENTS

JP 2006-124051 5/2006

* cited by examiner

*Primary Examiner* — Michael McCullough

(74) *Attorney, Agent, or Firm* — Fitzpatrick, Cella, Harper & Scinto

(57) ABSTRACT

A sheet stacking device has a discharging portion, a holding portion that holds a downstream end portion of the sheet, a stacking portion and a control portion that controls the discharging portion and the holding portion. The control portion controls at least one of the discharging portion and a holding portion so that the movement velocity of the holding portion is higher than the sheet discharge velocity of the discharging portion, and separates the sheet from the holding portion by using a velocity difference between the movement velocity and the sheet discharge velocity.

15 Claims, 13 Drawing Sheets

SHEET STACKING APPARATUS AND IMAGE FORMING APPARATUS

BACKGROUND OF THE INVENTION

1. Field of the Invention

The present invention relates to a sheet stacking apparatus in which sheets are stacked, and an image forming apparatus that includes the sheet stacking apparatus in an apparatus main body thereof.

2. Description of the Related Art

In the past, an image forming apparatus, which forms an image on a sheet, may often include a sheet stacking apparatus, which is disclosed in Japanese Patent Application Laid-Open (JP-A) No. 2006-124051, in an apparatus main body thereof. A large number of sheets, on which images have been formed, discharged from an apparatus main body are stacked in the sheet stacking apparatus. Meanwhile, the sheet stacking apparatus disclosed in JP-A No. 2006-124051 is called a stacker that can stack a large number of sheets therein.

FIG. 13 is a schematic front view of the stacker that is disclosed in JP-A No. 2006-124051. The stacker 500 holds a downstream end portion (front end portion) of a sheet in a sheet discharging direction by a gripper 503, pulls the sheet, and stacks the sheet on a sheet stacking table 505. That is, after receiving the sheet discharged from an apparatus main body of an image forming apparatus by an inlet roller 501, the stacker 500 grips the front end portion of the sheet by the gripper 503, pulls the sheet, and makes the sheet collide with a stopper 504.

When colliding with the stopper 504, the sheet falls down from the gripper 503 and is stacked on the sheet stacking table 505. The stacker 500 repeatedly operates until a predetermined number of sheets are stacked on the sheet stacking table 505. Members 506 and 507 are front and rear end pressing members for pressing the discharged preceding sheet so that the discharge of the succeeding sheet is not hindered.

In a sheet stacking apparatus (hereinafter, referred to as a stacker) disclosed in U.S. Pat. No. 6,641,133, a gripper, which grips a front end portion of a sheet, is opened by being abutted against a fixing member so that a sheet is released.

However, the stackers disclosed in JP-A No. 2006-124051 and U.S. Pat. No. 6,641,133 separate and stack a sheet by making the gripper be bumped against the stopper and the fixing member. For this reason, sheets, which are to be stacked on the stackers disclosed in JP-A No. 2006-124051 and U.S. Pat. No. 6,641,133, do not have horizontal components of velocity when being moved by the gripper, and freely fall down on the stackers under one's own weight. Since the fall times of the sheets are lengthened due to air resistance, it is necessary to start discharging a subsequent sheet after completion of stacking a preceding sheet and the fall positions of the sheets become non-uniform due to air resistance when the sheets fall down, the stackers in the related art have low stacking efficiency and poor stack alignment of sheets. Accordingly, it is considered to shorten the fall time of a sheet and make the fall position of a sheet be uniform by pressing a falling sheet from above. However, if a mechanism for pressing a falling sheet from above is provided in the stacker, there are other problems in that the stacker is complicated and increased in size.

Further, in the stacker disclosed in JP-A No. 2006-124051, the gripper is bumped against the stopper while holding a front end portion of a sheet, so that the sheet is separated from the gripper. Since the front end portion of the sheet is restricted by the gripper, there has been a concern that the stopper damages the front end portion of the sheet when stopping the inertial force of the gripper. In particular, there has been a concern that the stopper damages the sheet fed from the apparatus main body of the image forming apparatus at high velocity.

Further, in the stacker disclosed in U.S. Pat. No. 6,641,133, a mechanism for separating a sheet from the gripper is complicated, so that the stacker is increased in size and manufacturing cost thereof is increased.

When there are damaged sheets in an image forming apparatus including a sheet stacking apparatus, which has a concern that the front end portion of the sheet is damaged, in an apparatus main body thereof, the image forming apparatus should form images several times as many as the number of damaged sheets. For this reason, the productivity of the image forming apparatus is low.

The invention provides a sheet stacking apparatus that releases the holding of a sheet without bumping the sheet against a stopper, quickly and stably discharges and stacks the sheet, and improves stacking efficiency and stack alignment without increasing the apparatus in size.

The invention provides an image forming apparatus that includes a sheet stacking apparatus decreasing the damage to a sheet and improves productivity.

SUMMARY OF THE INVENTION

A sheet stacking apparatus includes: a discharging portion that discharge a sheet; a moving portion that and moves the sheet to the downstream side in the sheet discharging direction while holding a downstream end portion of the sheet, discharged by the discharging portion, in a sheet discharging direction; a stacking portion on which the sheet is stacked; and a control portion that controls the discharging portion and the moving portion, wherein the control portion controls at least one of the discharging portion and the moving portion so that the movement velocity of the moving portion is higher than the sheet discharge velocity of the discharging portion, and separates the sheet from the moving portion by using a velocity difference between the movement velocity and the sheet discharge velocity.

An image forming apparatus according to an embodiment of the invention includes an image forming portion that forms an image on a sheet, and a sheet stacking apparatus on which the sheet (on which the image is formed by the image forming portion) is stacked.

The sheet stacking apparatus according to the embodiment of the invention makes the movement velocity of the moving portion be higher than the sheet discharge velocity of the discharging portion, and separates the sheet from the moving portion by using velocity difference. Accordingly, in the sheet stacking apparatus according to the embodiment of the invention, a sheet to be stacked is landed on a sheet stacking portion by inertia when being discharged. As a result, it may be possible to quickly and stably stack a sheet.

Further, in the sheet stacking apparatus according to the embodiment of the invention, the separated sheet is stacked on the stacking portion by an inertial force, which is applied from the discharging portion in the sheet discharging direction, without depending on the fall that is caused by the weight of the sheet. Therefore, it may be possible to improve the stacking efficiency of a sheet by shortening the time to stack a sheet.

Further features of the present invention will become apparent from the following description of exemplary embodiments (with reference to the attached drawings).

DESCRIPTION OF THE EMBODIMENTS

A sheet stacking apparatus according to an embodiment of the invention, and an image forming apparatus that includes the sheet stacking apparatus in an apparatus main body thereof will be described below with reference to the drawings.

(Image Forming Apparatus)

Figure 1:
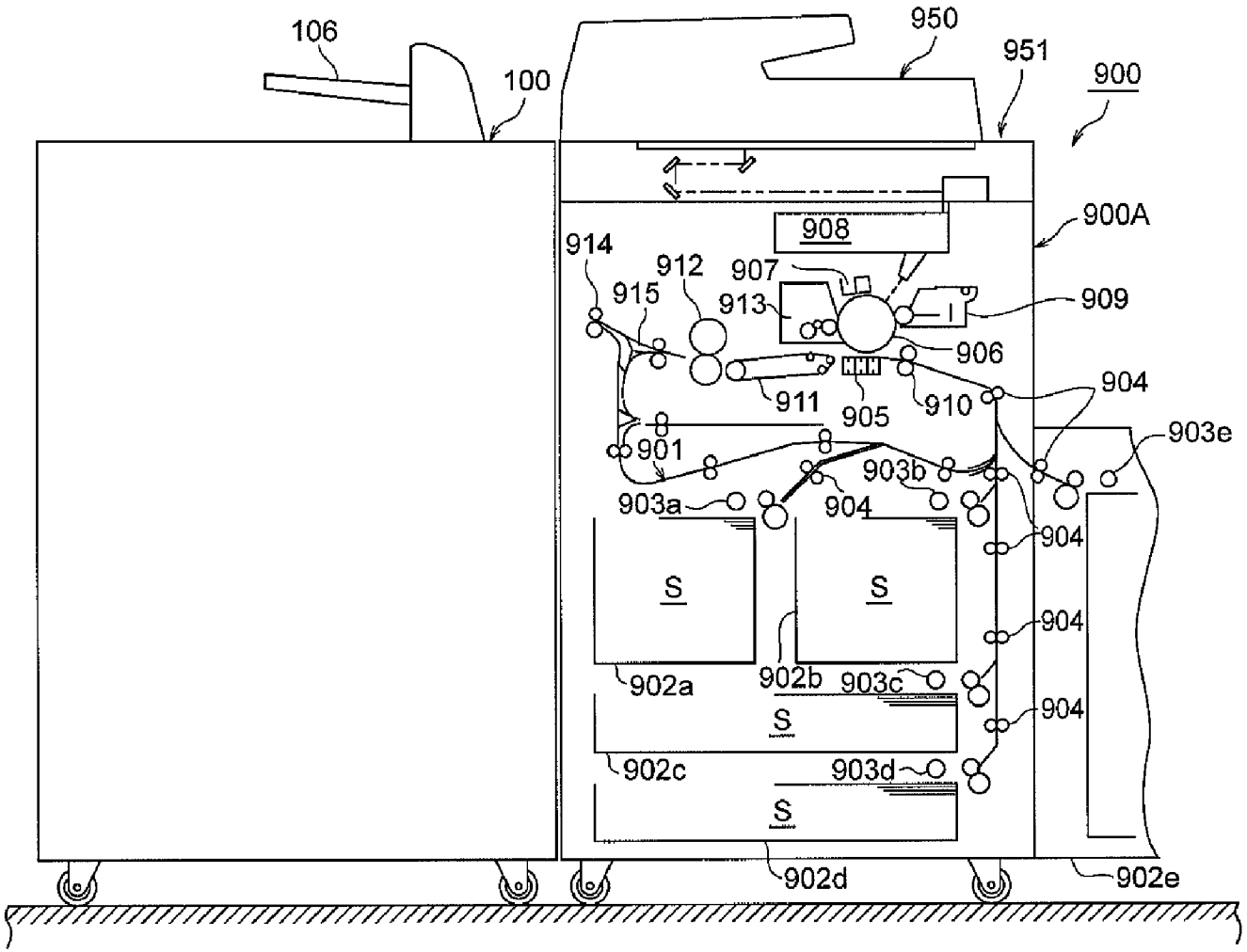
FIG. 1 is a schematic cross-sectional view of an image forming apparatus according to an embodiment of the invention taken along a sheet conveying direction.

FIG. 1 is a schematic cross-sectional view of an image forming apparatus taken along a sheet conveying direction. An image forming apparatus 900 forms an image on a sheet in an apparatus main body 900A, and then feeds the sheet on which the image has been formed to a stacker 100, which serves as a sheet stacking apparatus connected to the apparatus main body 900A, so that the sheet is stacked in the stacker. A large number of sheets can be stacked in the stacker 100. The apparatus main body 900A reads out a document, which is fed from an automatic document feeding device 950 (which is provided at an upper portion of the apparatus main body) to an image reading apparatus 951, by the image reading apparatus 951, and makes a copy of the document.

Meanwhile, the apparatus main body 900A may read out the document, which is stacked on the image reading apparatus 951 by a user, and make a copy of the document. Accordingly, the apparatus main body does not need to be necessarily provided with the automatic document feeding device 950. Further, the apparatus main body 900A may form an image on a sheet based on image information that is sent from a personal computer or a facsimile. Accordingly, the apparatus main body does not need to be necessarily provided with the image reading apparatus 951 and the automatic document feeding device 950.

The operation of the apparatus main body 900A will be described. Sheets S, which are set in sheet cassettes 902*a* to 902*e*, are conveyed to a pair of registration rollers 910 by sheet feeding rollers 903*a* to 903*e* and a pair of conveying rollers 904.

Meanwhile, an exposurer 908 irradiates a photosensitive drum 906, which is charged with electricity by a primary charger 907, with laser light and forms an electrostatic latent image on the photosensitive drum based on digital document data that is read out from a document fed by the automatic document feeding device 950 by the image reading apparatus 951. The electrostatic latent image is developed with toner by a development device 909 and is changed into a toner image. The photosensitive drum 906, the development device 909, and the like form an image forming portion.

A front end of the sheet is aligned with a front end of the toner image of the photosensitive drum 906 and the sheet is fed between the photosensitive drum 906 and a transfer separating charger 905 by the pair of registration rollers 910. The transfer separating charger 905 applies a transfer bias to the sheet and transfers the toner image, which is formed on the photosensitive drum 906, to the sheet. When the toner image is transferred, residual toner remaining on the photosensitive drum 906 is scraped off by blades of a cleaning device 913. The surface of the photosensitive drum 906 is cleaned so as to prepare next image formation.

The sheet onto which the toner image is transferred is fed to a fixer 912 by a conveyor belt 911. The sheet is heated and pressed by the fixer 912, so that the toner image is fixed to the sheet. The sheet is conveyed to the stacker 100 as it is by the discharge roller 914, or is conveyed to a both surface reversing device 901 by a switching member 915 so that an image is formed on one surface of the sheet again.

(System Block Diagram)

Figure 2:
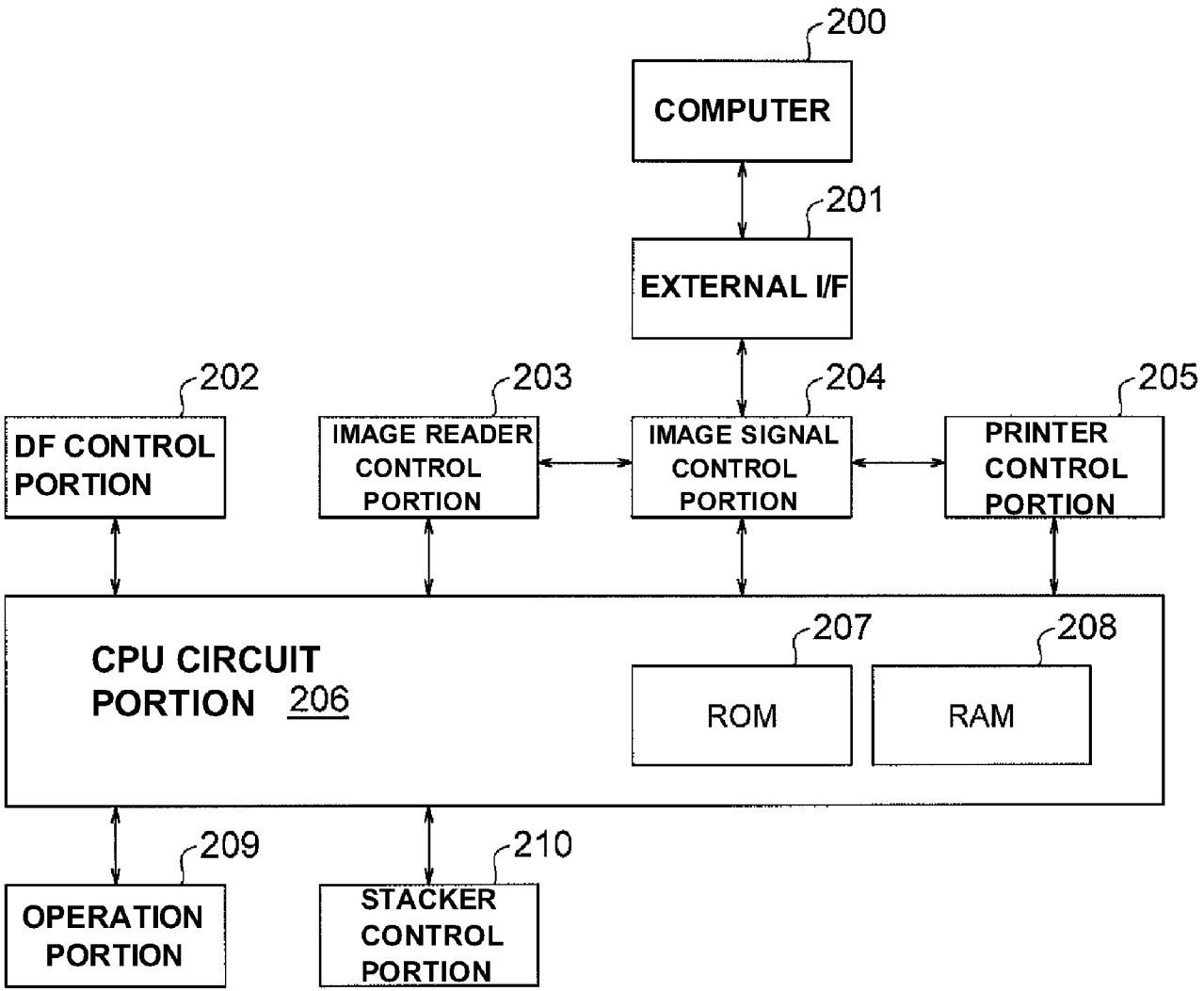
FIG. 2 is a block diagram illustrating the configuration of a controller that controls the entire image forming apparatus of FIG. 1.

The configuration of a controller that controls the entire image forming apparatus will be described below. FIG. 2 is a block diagram illustrating the configuration of a controller that controls the entire image forming apparatus of FIG. 1.

A controller includes a CPU circuit portion 206. A CPU (not illustrated), a ROM 207, and a RAM 208 are built in the CPU circuit portion 206. The CPU circuit portion controls blocks 202 to 205 and 210 by control programs, which are stored in the ROM 207, as a whole. The RAM 208 temporarily stores control data, and is used as a work area for arithmetic processing that accompanies with the control.

A DF (document feeding) control portion 202 drives and controls the automatic document feeding device 950 based on the instructions sent from the CPU circuit portion 206. An image reader control portion 203 drives and controls a scanner unit, an image sensor, and the like of the image reading apparatus 951 (not illustrated). The image reader control portion transmits an analog image signal, which is output from the image sensor, to an image signal control portion 204.

After converting an analog image signal, which is output from the image sensor, into a digital signal, the image signal control portion 204 performs various kinds of processing on the digital signal so as to convert the digital signal into a video signal. Then, the image signal control portion outputs the video signal to a printer control portion 205. Further, the image signal control portion 204 performs various kinds of processing on the digital image signal that is input from an external computer 200 through an external I/F 201, so as to convert the digital image signal into a video signal. Then, the image signal control portion outputs the video signal to the printer control portion 205. The processing operation, which is performed by the image signal control portion 204, is controlled by the CPU circuit portion 206. The printer control portion 205 drives the exposure based on the input video signal.

An operation portion 209 includes a plurality of keys that is used to set various functions related to image formation, and a display portion that displays information indicating a setting state. The operation portion 209 outputs a key signal, which corresponds to the operation of each of the keys, to the CPU circuit portion 206, and displays corresponding information on the display portion based on the signals output from the CPU circuit portion 206.

A stacker control portion (sheet stacking apparatus control portion) 210 as a control portion is mounted on the stacker 100, and controls the operation of the entire stacker by transmitting/receiving information to/from the CPU circuit portion 206 of the image forming apparatus. The stacker control portion 210 controls various motors and sensors.

The configuration of the stacker control portion (sheet stacking apparatus control portion) 210 that drives and controls the stacker 100, and portions related to the stacker control portion 210 will be described below with reference to FIG. 3. The stacker control portion 210 includes a CPU 800, a ROM 801, a RAM 802, and the like. The stacker control portion 210 exchanges data with the CPU circuit portion 206 of the apparatus main body of the image forming apparatus through a communication IC 804, and executes the respective programs stored in the ROM 801 based on the instructions of the CPU circuit portion 206, thereby driving and controlling the stacker 100.

When driving and controlling the stacker, the stacker control portion 210 receives detection signals from various sensors. The various sensors include a timing sensor 111, a sheet surface detecting sensor 117, a tray HP sensor 113, and a gripper detecting sensor 153. These sensors are used for controlling the stacker 100. A driver 803 is connected to the stacker control portion 210, and the driver 803 controls the stacker 100 by controlling motors 132 to 135 and solenoids 130 and 131 based on the signal output from the stacker control portion 210.

Meanwhile, in this embodiment, the stacker 100 has been controlled by the stacker control portion 210 that is mounted on the stacker 100. However, the invention is not limited to this embodiment, and the stacker control portion 210 may be formed integrally with the CPU circuit portion 206 of the image forming apparatus main body and the stacker 100 may be directly controlled by the image forming apparatus main body.

(Stacker (Sheet Stacking Apparatus))

Figure 4:
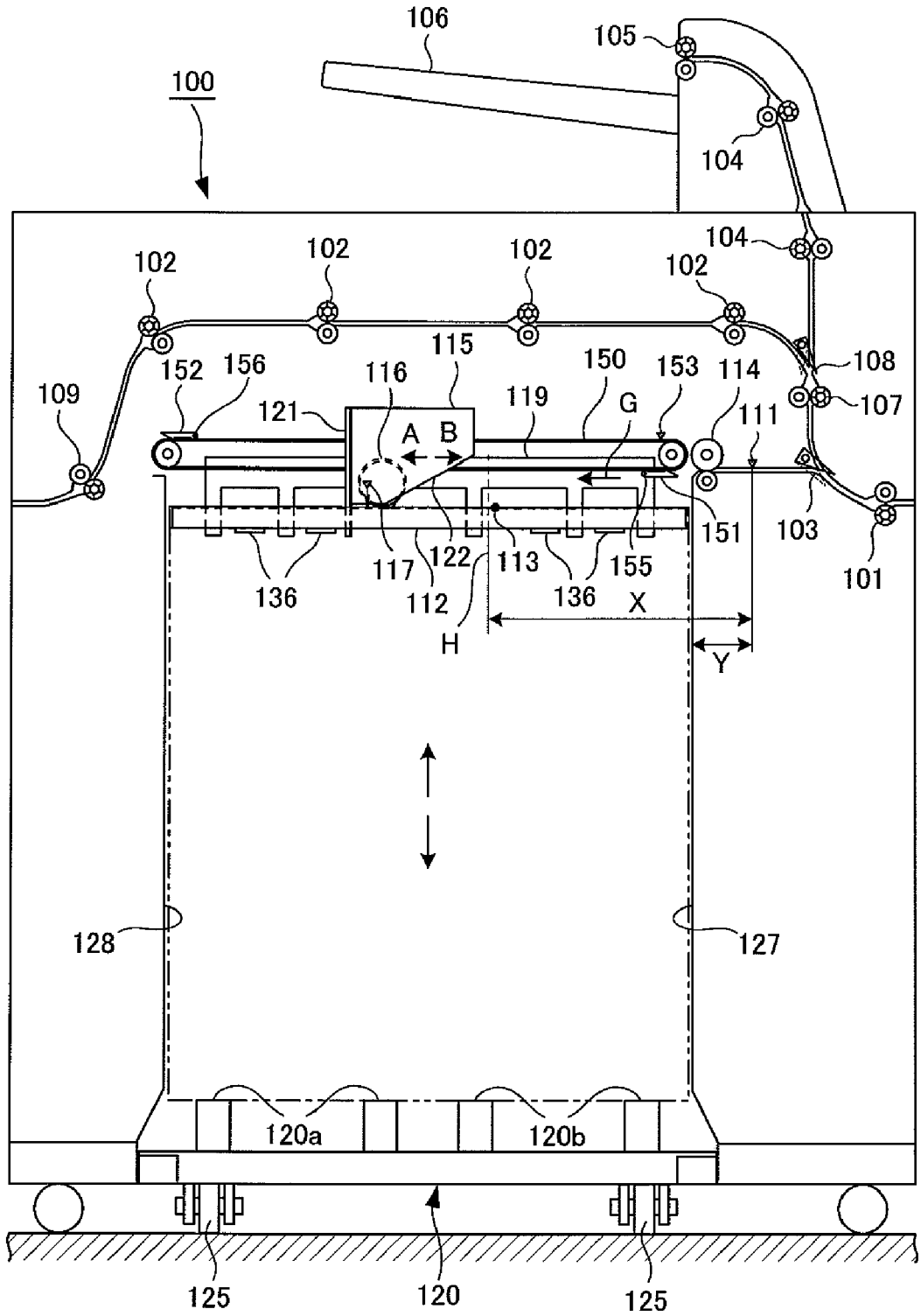
FIG. 4 is a schematic cross-sectional view of the sheet stacking apparatus taken along a sheet discharging direction (sheet conveying direction)
Figure 5:
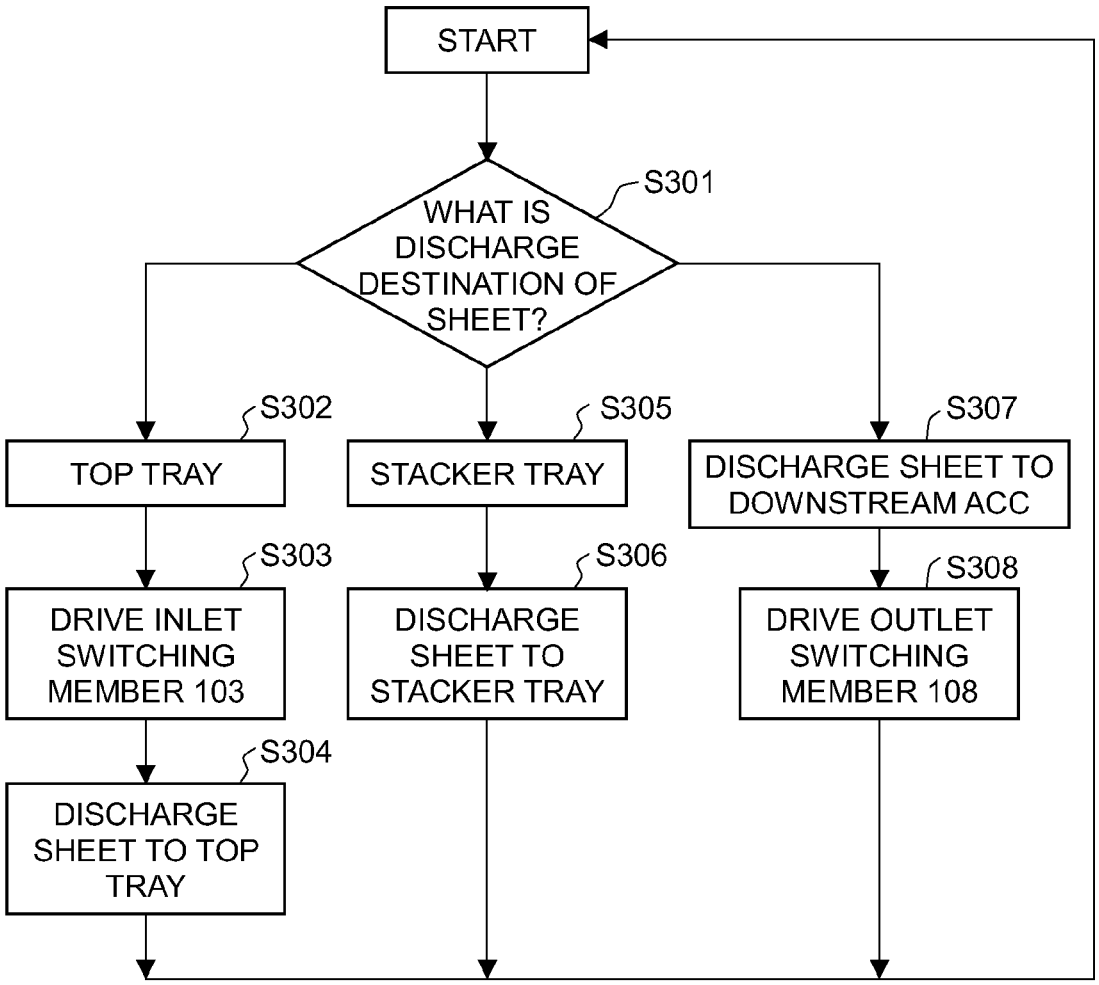
FIG. 5 is a flowchart schematically illustrating the operation of the sheet stacking apparatus.

The stacker 100 will be described. FIG. 4 is a schematic cross-sectional view of the stacker taken along a sheet discharging direction (sheet conveying direction). FIG. 5 is a flowchart schematically illustrating the operation of the stacker.

The sheet, which is discharged from the apparatus main body 900A of the image forming apparatus 900, is conveyed into the stacker 100 by a pair of inlet rollers 101 of the stacker 100. Before the sheet is conveyed, information about the sheet is previously sent to the stacker control portion 210 from the CPU circuit portion 206 of the apparatus main body 900A of the image forming apparatus. The information about the sheet includes information about the size of the sheet, the type of the sheet, and the discharge destination of the sheet.

A case where the discharge destination of the sheet is a top tray 106 for small number of stacking sheets, provide on an upper portion of the stacker 100, will be described (S301 and S302). An inlet switching member 103 is switched to a position, which is illustrated by a broken line, by a solenoid 130 for the inlet switching member of FIG. 3, and guides the sheet to a pair of conveying rollers 107 (S303). After that, an outlet switching member 108 is switched to a position, which is illustrated by a broken line, by a solenoid 131 for the outlet switching member of FIG. 3, and guides the sheet to a pair of conveying rollers 104. The sheet is conveyed to the pair of conveying rollers 104, and is discharged to the top tray 106 by a pair of top tray discharge rollers 105 (S304).

A case where the discharge destination of the sheet is a sheet processing apparatus (not illustrated) provided on the downstream of the stacker will be described (S301 and S307). The inlet switching member 103 is switched to a position, which is illustrated by a broken line, by the solenoid 130 for the inlet switching member of FIG. 3, and guides the sheet to the pair of conveying rollers 107. After that, the outlet switching member 108 is switched to a position, which is illustrated by a solid line, by the solenoid 131 for the outlet switching member (S308). The sheet is guided to a pair of conveying rollers 102, is conveyed by the pair of conveying rollers 102 and a pair of stacker outlet rollers 109, and is fed to a sheet processing apparatus (not illustrated).

If the discharge destination of the sheet is a stacker tray 112 as a stacking portion (S301 and S305), the sheet conveyed by the pair of inlet rollers 101 is guided to a pair of discharge rollers 114 by the inlet switching member 103 and discharged to the stacker tray 112 (S306). This discharge operation will be described in detail.

When a sheet is stacked into the stacker, the stacker 100 performs an initial operation for receiving the sheet as follows:

Sheet size information, which is input to the operation portion 209 by a user, is sent to the stacker control portion 210 from the CPU circuit portion 206. The stacker control portion 210 moves a sheet pulling unit 115, serves as a positioning unit, in a direction of an arrow A or B (sheet discharging direction) by the motor 132 for the pulling unit of FIG. 3 based on the sheet size information while guiding the sheet pulling unit by a guide member (not illustrated). In this case, the distance between a stopper 121 and the pair of discharge rollers 114, which is a discharging portion for discharging a sheet, is substantially equal to the length of the sheet based on the sheet size information. The stopper 121, which is provided on the sheet pulling unit 115 and serves as a positioning portion, positions the downstream end (front end) of the sheet, which is stacked on the stacker tray 112, in the sheet discharging direction.

Figure 3:
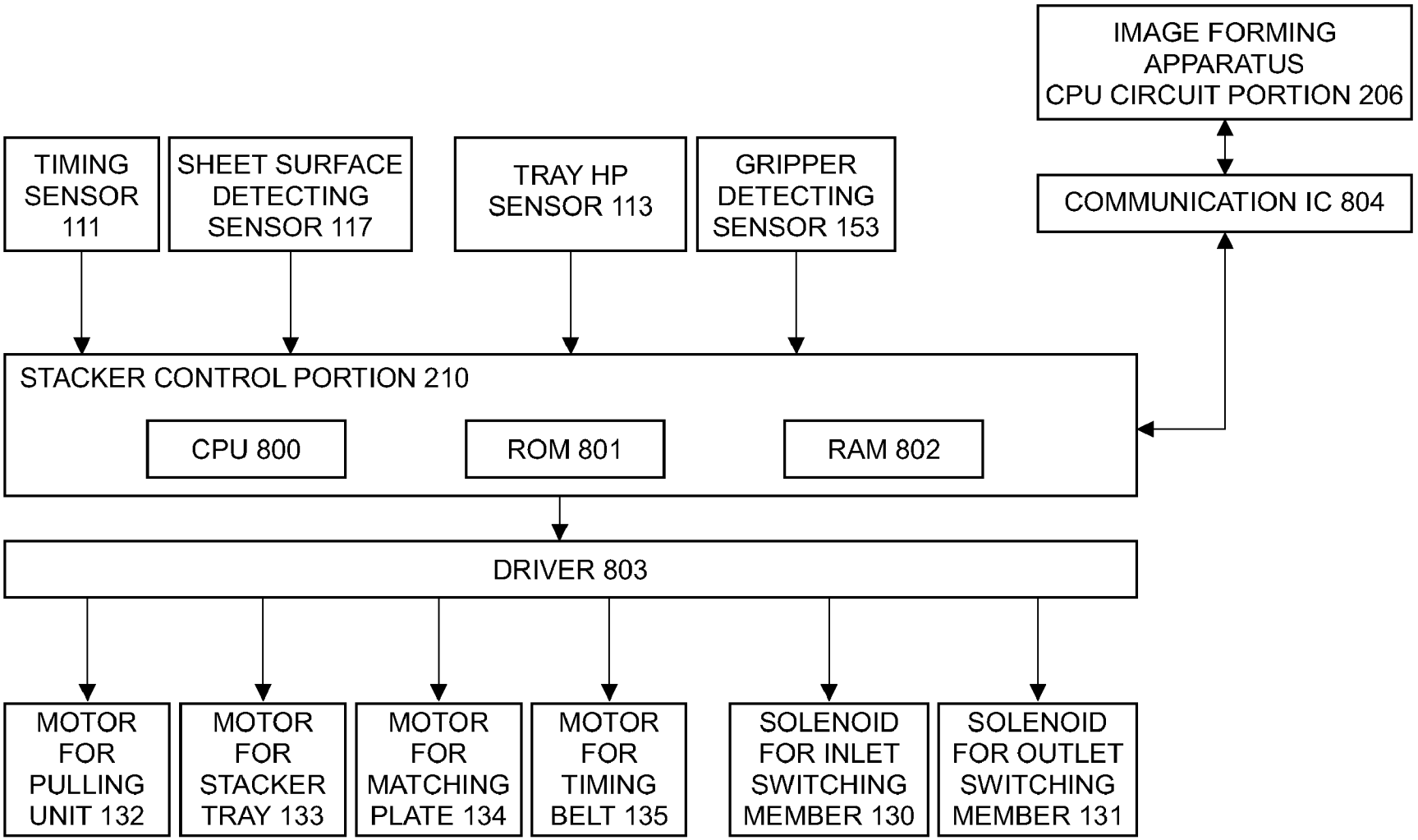
FIG. 3 is a block diagram illustrating the configuration of a stacker control portion according to the embodiment that drives and controls a sheet stacking apparatus (stacker) and portions of the invention that are related to the stacker control portion.

Further, the upper surface of the stacker tray 112 is lifted and lowered to a position, which is detected by the tray HP sensor 113, by the motor 133 for the stacker tray of FIG. 3. The stacker tray 112 is placed on a supporting member 136, which is lifted and lowered by the motor 133 for the stacker tray, and is lifted and lowered. A aligning plate 119 is moved to a position corresponding to the width of a sheet by the motor 134 for the aligning plate of FIG. 3, and waits at the position.

Figure 6:
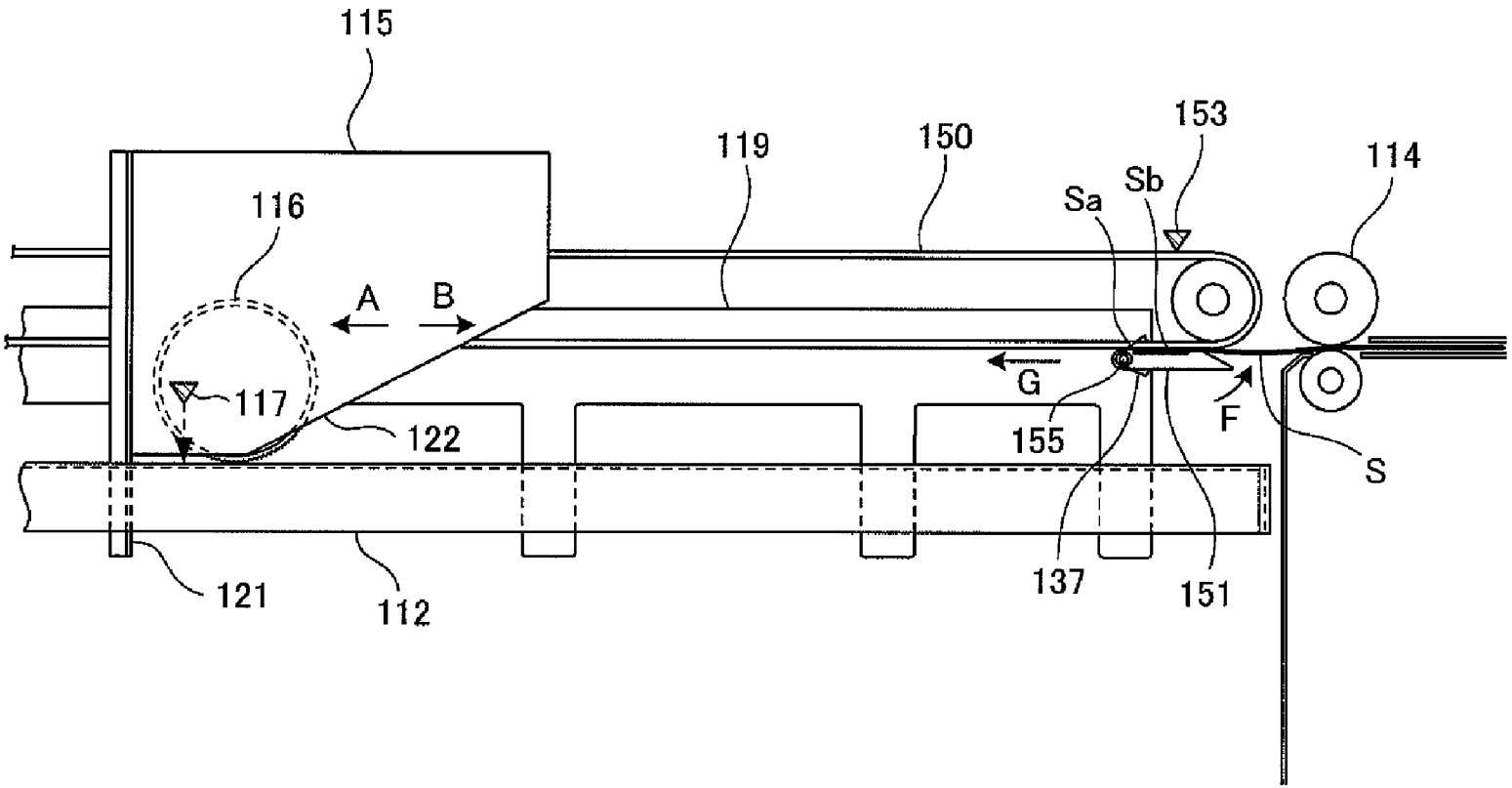
FIG. 6 is a view illustrating that a gripper grips a sheet.

Grippers 151 and 152 are provided on a timing belt 150 so as to rotate about fulcrums 155 and 156, and are pushed by springs 137 and 138 with predetermined loads so as to be rotated in a direction of an arrow F in FIG. 6. The sheet is gripped between the gripper 151 or 152 and the timing belt 150. Two grippers 151 and 152 are provided on the timing belt 150 at an interval of 180°. The timing belt 150 is rotated in a clockwise direction by the motor 135 for the timing belt of FIG. 3, and moves the grippers 151 and 152 in a direction of an arrow G. The gripper detecting sensor 153 detects that the grippers 151 and 152 have passed. The stacker control portion 210 drives the motor 135 for the timing belt by a predetermined distance after the gripper 151 or 152 passes by the gripper detecting sensor 153, and then stops the motor for the timing belt. Accordingly, the gripper 151 or 152 is stopped at a sheet receiving position where the sheet is received. When these operations are terminated, the initial operation is terminated.

Meanwhile, the reason why the gripper 151 or 152 is stopped at the sheet receiving position is to tuck the downstream end portion (front end portion) Sb of the sheet in the sheet discharging direction into a gap between the gripper 151 or 152 and the timing belt 150 by the pair of discharge rollers 114. In this case, even though the gripper 151 or 152 is not stopped at the sheet receiving position, the stacker control portion 210 may make the movement velocity of the gripper 151 or 152 be lower than the sheet discharge velocity of the pair of discharge rollers 114 and make the sheet be held by the gripper. For this purpose, at least one of the rotating velocity of a motor (not illustrated) for driving the pair of discharge rollers 114 and the rotating velocity of the motor 135 for the timing belt is controlled. A timing to control velocity is a timing where the stacker control portion 210 drives the motor 135 for the timing belt by a predetermined distance after the gripper 151 or 152 passes by the gripper detecting sensor 153. Accordingly, the gripper 151 or 152 does not need to be necessarily stopped once after being detected by the gripper detecting sensor 153.

A case where the sheet is conveyed by the gripper 151 will be described in the following description. However, since this is the same as a case where the sheet is conveyed by the gripper 152, the operation of the gripper 152 will be omitted.

Meanwhile, the number of grippers is not limited to 2. A single gripper may be provided and several grippers may be provided. Further, when several grippers are provided, the grippers do not need to be disposed at regular intervals but it is preferable that the grippers be disposed at regular intervals.

The grippers 151 and 152, the timing belt 150, the motor 135 for the timing belt, and the like form a moving portion that moves the sheet to the downstream side in the sheet discharging direction while holding the front end portion of the sheet discharged by the pair of discharge rollers 114 and pulling the sheet. However, an electrostatic unit (not illustrated) charged with static electricity may be provided on the timing belt instead of the grippers, so as to attract the front end portion of the sheet by static electricity and convey the sheet to the downstream side in the sheet conveying direction. Further, an air suction unit for sucking air may be provided on the timing belt instead of the grippers, so as to attract the front end portion of the sheet by air suction and convey the sheet to the downstream side in the sheet conveying direction. Furthermore, the grippers, the electrostatic unit, and the air suction unit have been formed so as to be moved by the timing belt. However, a chain, a wire, or the like, which is rotated like the timing belt, may be used instead of the timing belt. In addition, a guide rail may be used instead of a winding body for the timing belt, the chain, the wire, or the like. Accordingly, the moving portion is not limited to the grippers 151 and 152 or the timing belt 150.

As illustrated in FIG. 6, the sheet conveyed from the pair of inlet rollers 101 (FIG. 4) is guided to the pair of discharge rollers 114 by the inlet switching member 103. In this case, the timing sensor 111 detects that the front end Sa of the sheet S has passed. In this case, since the gripper 151 is stopped or moved at a velocity lower than the sheet discharge velocity of the pair of discharge rollers 114, the front end portion of the sheet is tucked against the spring 137 into the gap between the gripper 151 and the timing belt 150 and is gripped by the gripper 151.

The stacker control portion 210 counts a timing, where the sheet is tucked into the gap between the gripper 151 and the timing belt 150, based on the detection operation of the timing sensor 111, and starts the motor 135 for the timing belt. Accordingly, the timing belt 150 is rotated in a clockwise direction, so that the gripper 151 moves the entire sheet to the left side while pulling a front end portion Sb of the sheet in a left direction (a direction of an arrow G) in FIG. 6.

Figure 7:
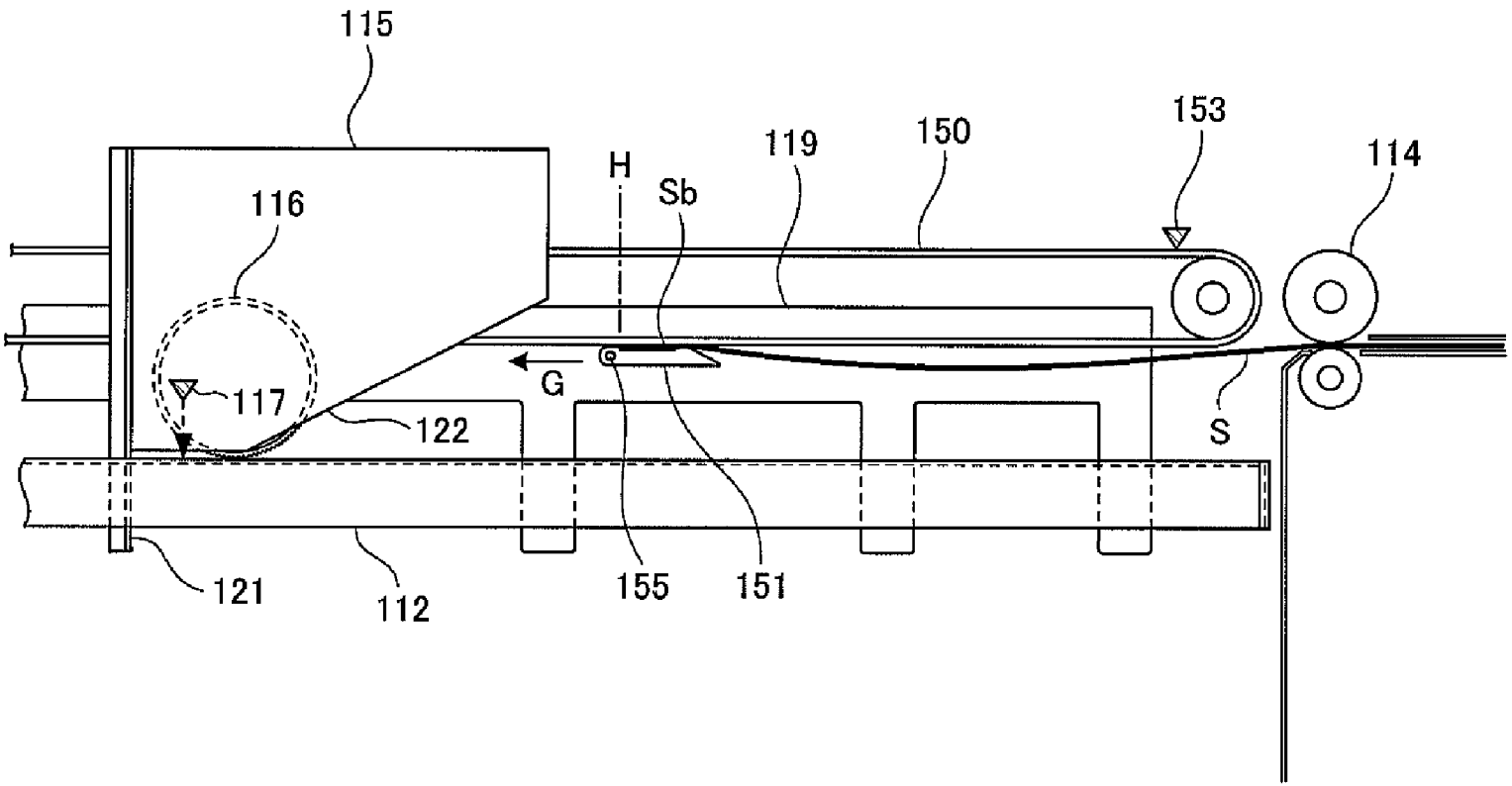
FIG. 7 is a view illustrating that the gripper conveys a sheet up to a separation point.

In this case, the movement velocity of the gripper 151 and the sheet discharge velocity of the pair of discharge rollers 114 are set to be equal to each other. For this reason, as illustrated in FIG. 7, the gripper 151 moves the sheet to the downstream side in the sheet discharging direction (in a direction of an arrow G) while gripping (holding) the front end portion Sb of the sheet S and pulling the sheet.

Further, before the front end Sa is abutted against a tapered portion 122 of the sheet pulling unit 115, the front end portion Sb of the sheet S needs to be separated from the gripper 151. Accordingly, whether to increase the movement velocity (V1) of the gripper 151, to decrease the sheet discharge velocity (V2) of the pair of discharge rollers 114, or to change two velocities (V1 and V2) at the same time is controlled. It may be possible to separate the front end portion Sb of the sheet from the gripper 151 by making a velocity difference between the movement velocity (V1) of the gripper 151 and the sheet discharge velocity (V2) of the pair of discharge rollers 114 as described above.

That is, $V1>V2$ Expression (1)

Expression (1) needs to be satisfied.

The timing to change velocity as described above is performed according to the length of the sheet after the timing sensor 111 detects the front end of the sheet. That is, before a rear end portion (upstream end portion) of the sheet S passes through the pair of discharge rollers 114, and before a front end portion (downstream end portion) of the sheet S reaches the sheet pulling unit 115, the front end portion Sb of the sheet is separated from the gripper 151. The sheet S, applied a inertial force in the discharging direction to the front end portion Sb, is discharged onto the stacker tray 112 by the pair of discharge rollers 114.

Further, a gripping force (sheet holding force) of the gripper 151 needs to be set to be smaller than a sheet holding force of the pair of discharge rollers 114 in order to allow the sheet to be separated from the gripper 151 by the velocity relationship of Expression (1). The gripping force of the gripper 151 is determined by a coefficient of friction between the gripper 151 and the timing belt 150 and a pushing force of the spring 137 for pushing the gripper 151 so that the gripper is rotated toward the timing belt 150. Further, the sheet holding force of the pair of discharge rollers 114 is determined by the coefficient of friction of the pair of discharge rollers 114, a contact pressure between the rollers at a grip, and the like.

Figure 8:
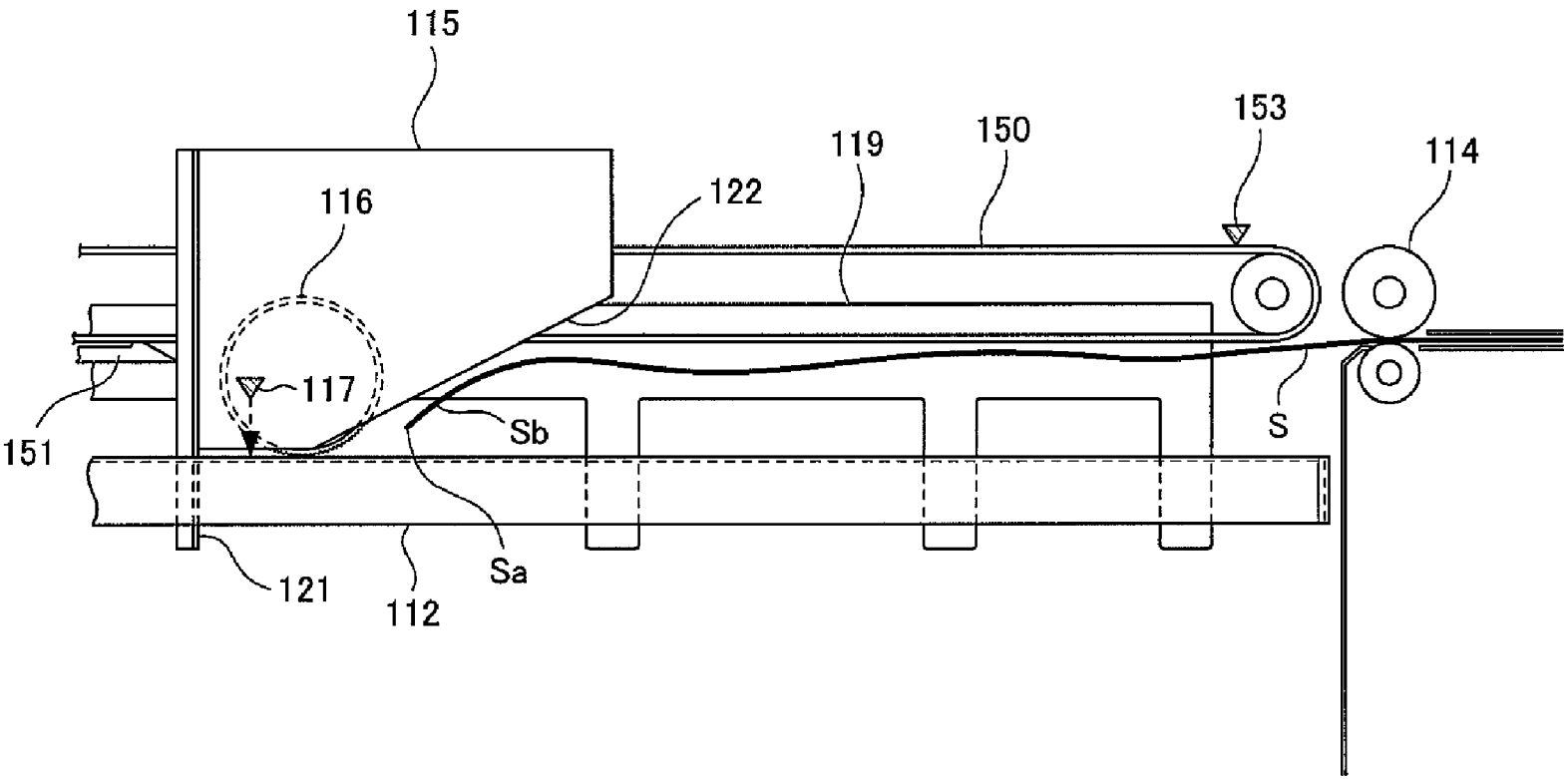
FIG. 8 is a view illustrating that a sheet separated from the gripper is bumped against a sheet stopper.
Figure 9:
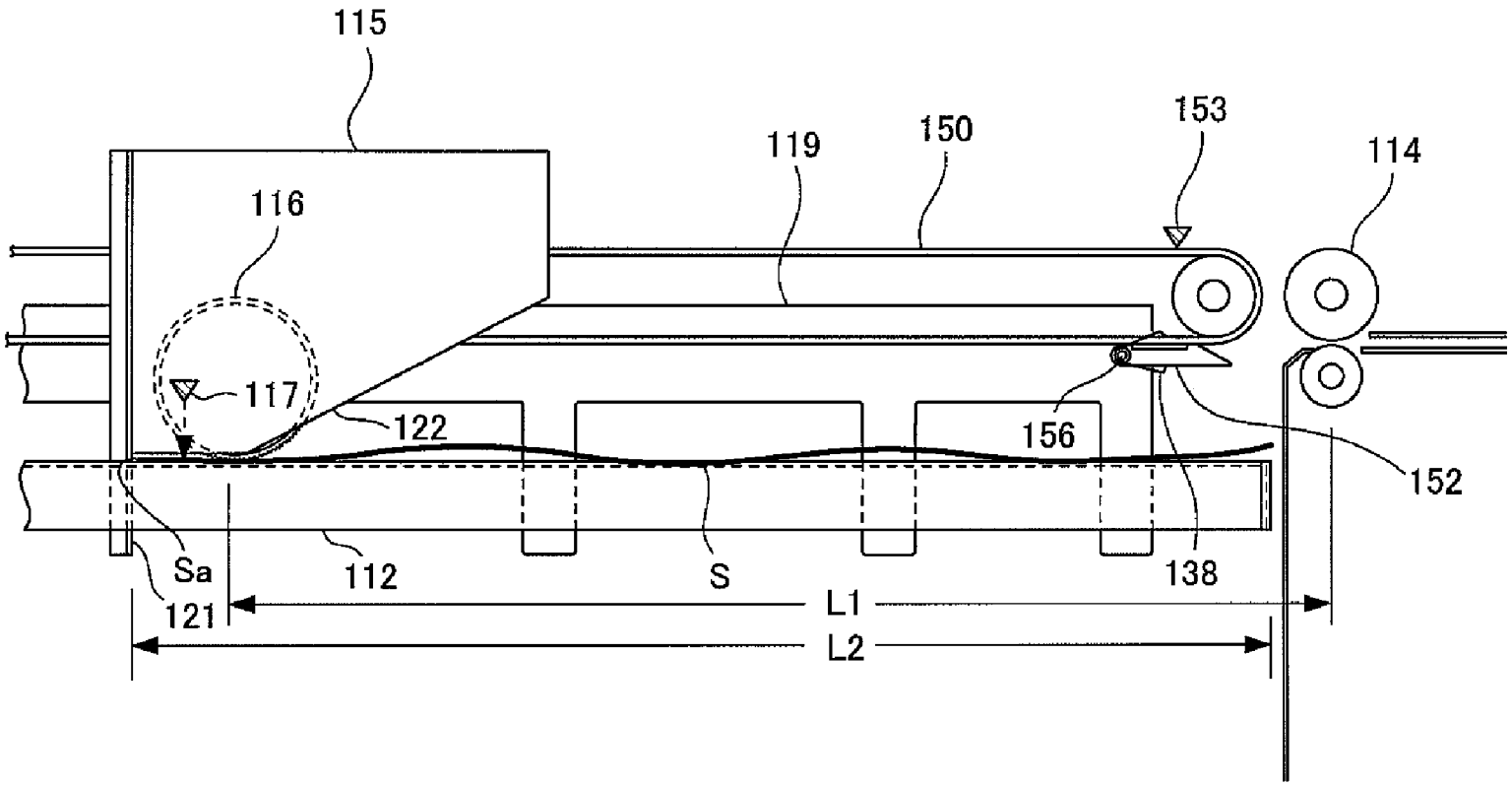
FIG. 9 is a view illustrating that a sheet separated from the gripper is bumped against the sheet stopper.

As illustrated in FIG. 8, the sheet S of which the front end portion Sb is separated from the gripper 151 is guided to the stacker tray 112 by the conveyance of the pair of discharge rollers 114 and the tapered portion 122 of the sheet pulling unit 115. In this case, an inertial force in the discharging direction is applied to the sheet S by the pair of discharge rollers 114, so that the sheet is more stably and more quickly landed and stacked on the stacker tray 112 than the case of the freely fall down. Accordingly, it may be possible to quickly and stably discharge the sheet S onto the stacker tray 112. Further, the inertial force of the sheet S due to one's own weight, which is not restricted by the gripper, is small. For this reason, even though the front end portion Sb of the sheet S collides with the stopper 121 or the tapered portion 122 of the sheet pulling unit 115, the sheet is not damaged. When the front end portion Sb of the sheet S reaches between a knurled belt 116 and the stacker tray 112, the front end portion Sb of the sheet S is pulled to the stopper 121 due to the rotation of the knurled belt 116. Further, as illustrated in FIG. 9, the sheet S is stacked on the stacker tray 112 and the front end of the sheet is abutted against the stopper 121. Since being made of rubber or a resin so as to have a ring shape, the knurled belt 116 has elasticity. Accordingly, the knurled belt comes in press contact with the stacker tray 112, or the knurled belt comes in press contact with the uppermost sheet when the sheets are stacked on the stacker tray 112. Further, the knurled belt 116 is rotated in the clockwise direction by a motor (not illustrated).

In the case of the skew feeding of sheet, the front end Sa of the sheet is abutted against the stopper 121 and then the sheet is conveyed to the rear side by the knurled belt 116, so that the skew feeding is compensated.

In this case, a distance (L1) between the knurled belt 116 and the pair of discharge rollers 114 is set to be shorter than the length (L2) of the sheet S in the conveying direction. If the distance between the knurled belt and the pair of discharge rollers is set as described above, it may be possible to reliably transfer the front end Sa of the sheet S between the knurled belt 116 and the stacker tray 112 before the sheet S is discharged from the pair of discharge rollers 114.

After the sheet S is stacked on the stacker tray 112, the sheet surface detecting sensor 117 detects whether the upper surface of the sheet is positioned at an appropriate height position. Then, the stacker tray 112 is lowered by the drive of the motor 133 for the stacker tray if necessary. It may be possible to maintain a pulling force (conveying force) of the knurled belt 116, which pulls a sheet between the knurled belt 116 and the stacker tray 112, at an appropriate value by adjusting the height position of the upper surface of the sheet to a predetermined position.

The stacker control portion 210 rotates the timing belt 150 by controlling the motor 135 for the timing belt while adjusting the height of the stacker tray 112 by controlling the motor 133 for the stacker tray. Further, when the other gripper 152 passes by the gripper detecting sensor 153 and is moved by a predetermined distance, the stacker control portion 210 stops the motor 135 for the timing belt. Accordingly, the gripper 152 is in a state where the gripper can grip the succeeding sheet, and is ready to convey the succeeding sheet. The stacker control portion 210 repeatedly performs this control, so that the sheet stacking apparatus 100 can sequentially stack sheets on the stacker tray 112.

Figure 12:
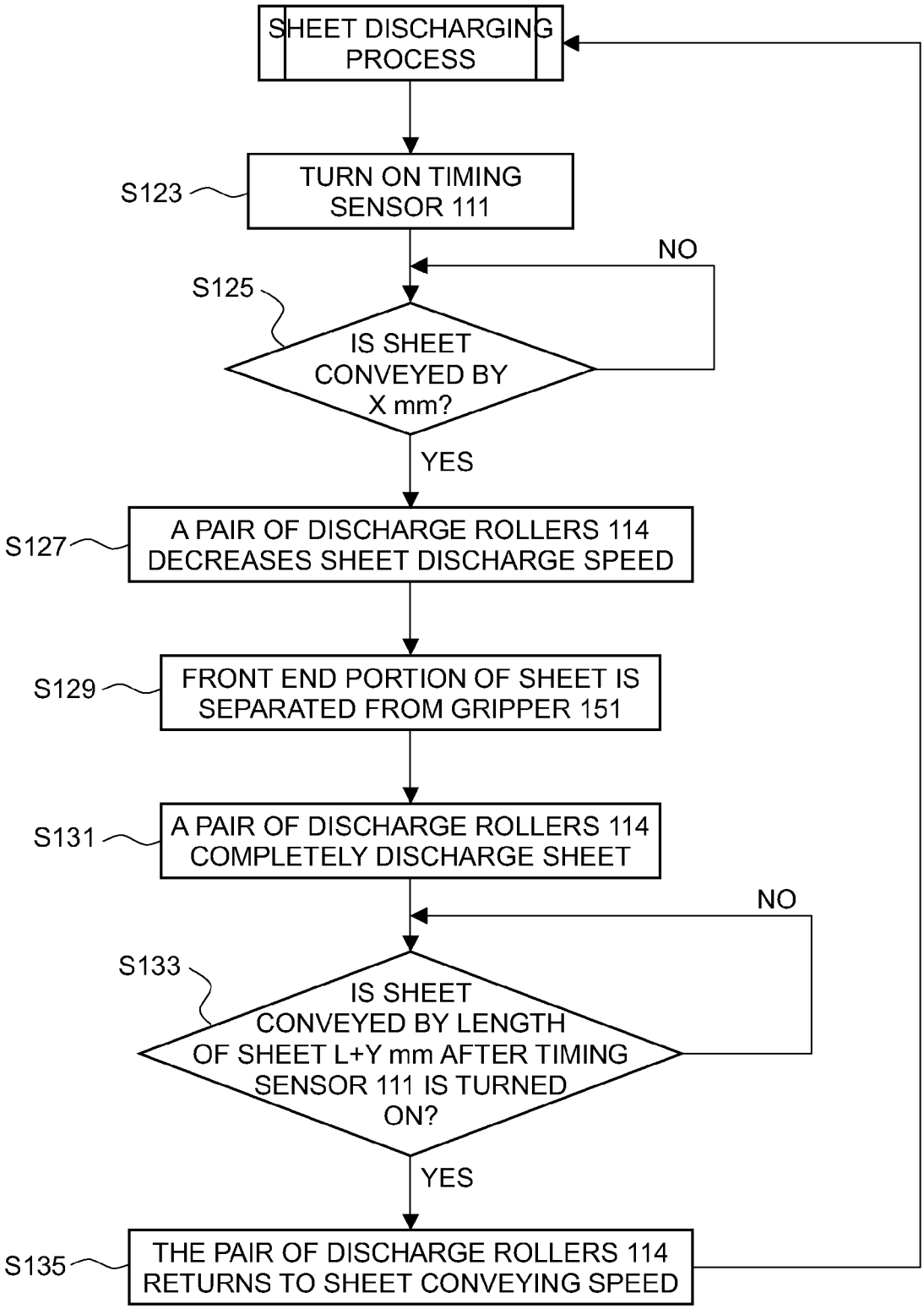
FIG. 12 is a flowchart illustrating the operation of the sheet stacking apparatus.
Figure 13:
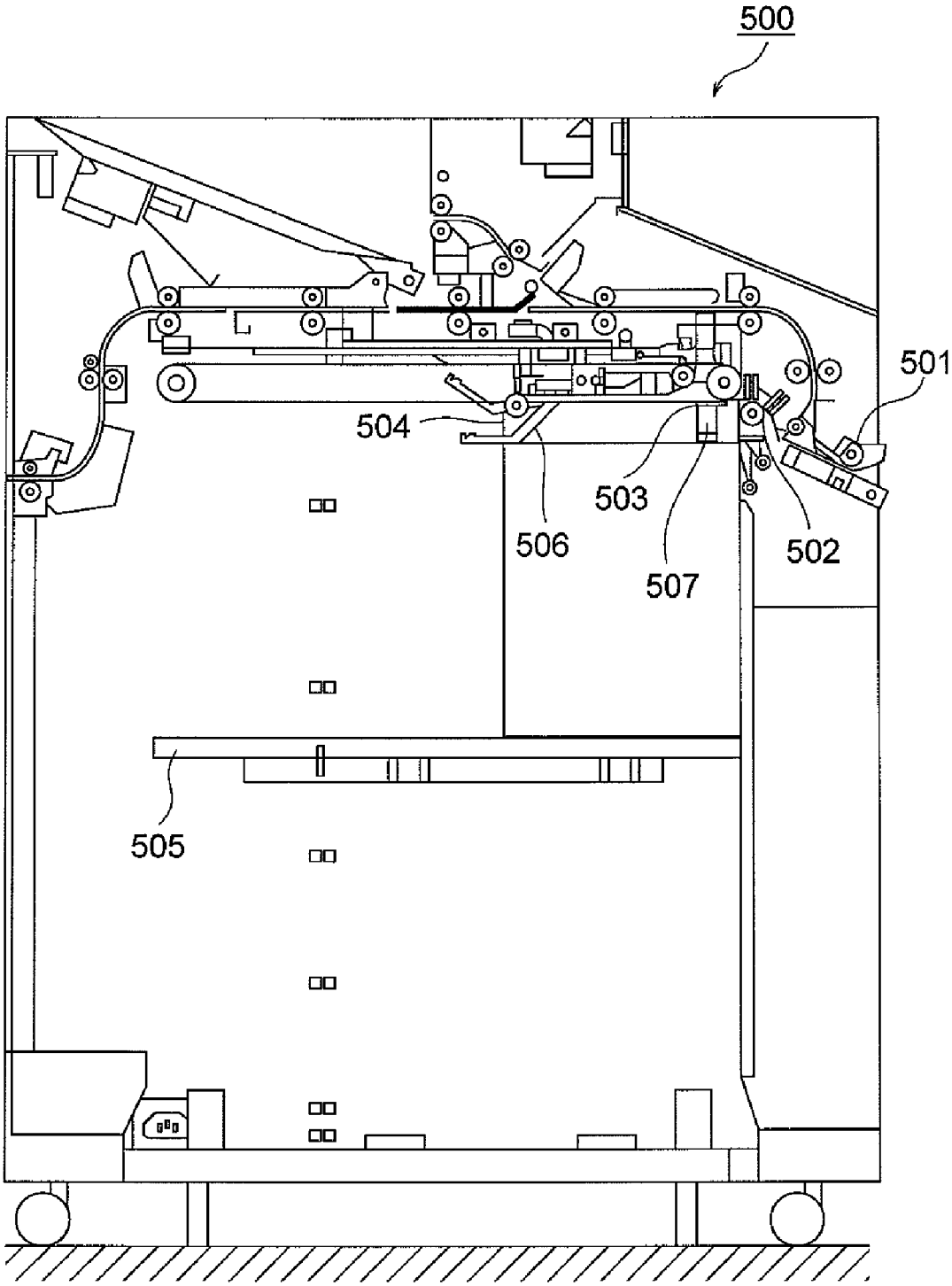
FIG. 13 PRIOR ART
FIG. 13 is a schematic front view of a sheet stacking apparatus in the related art.

The control of the operation of the stacker 100 for stacking a sheet will be described with reference to the flowchart of FIG. 12. The sheet, which is conveyed from the apparatus main body 900A of the image forming apparatus 900, passes by the timing sensor 111 (S123) and is conveyed to the pair of discharge rollers 114. Then, the front end Sa reaches a separation point H of FIGS. 4 and 7 (S125). Accordingly, the stacker control portion 210 decreases the sheet discharge velocity by rotating the pair of discharge rollers 114 while decreasing the velocity of the pair of discharge rollers (S127). The distance between the timing sensor 111 and the separation point H is X mm. The front end portion Sb of the sheet S is separated from the gripper 151 due to the difference between the movement velocity of the gripper 151 and the sheet conveying velocity of the pair of discharge rollers 114 based on Expression (1) (S129).

After that, the sheet is conveyed by the pair of discharge rollers 114, and the sheet reaches the stopper 121. This point is a position corresponding to a distance (L+Y) that is obtained by adding the distance Y (FIG. 4) between the timing sensor 111 and a guide wall 127 (FIG. 4) to the length L of the sheet from the timing sensor 111 (S133). Guide walls 127 and 128 are provided to guide the sheet that is discharged to the stacker tray 112 and to prevent the misalignment of the front and rear ends of the sheets that are stacked on the stacker tray 112 when the stacker tray 112 is lifted and lowered. The distance between the guide walls 127 and 128 is set to a distance that allows the stacker tray 112 to be lifted and lowered.

When the front end of the sheet is abutted against the stopper 121, the rear end portion (upstream end portion) of the sheet passes through the pair of discharge rollers 114 substantially at the same time. Then, the sheet is stacked on the stacker tray 112. Accordingly, a first sheet is completely stacked by the stacker 100. The stacker control portion 210 makes the sheet discharge velocity of the pair of discharge rollers 114 return to the original velocity (S135) so that the stacker 100 can stack the next sheet.

Here, Expression (1) is satisfied by the decrease of the sheet discharge velocity of the pair of discharge rollers 114. However, Expression (1) may be satisfied by the decrease of the sheet discharge velocity (V2) of the pair of discharge rollers 114 or the simultaneous change of both the velocities (V1 and V2).

Figure 10:
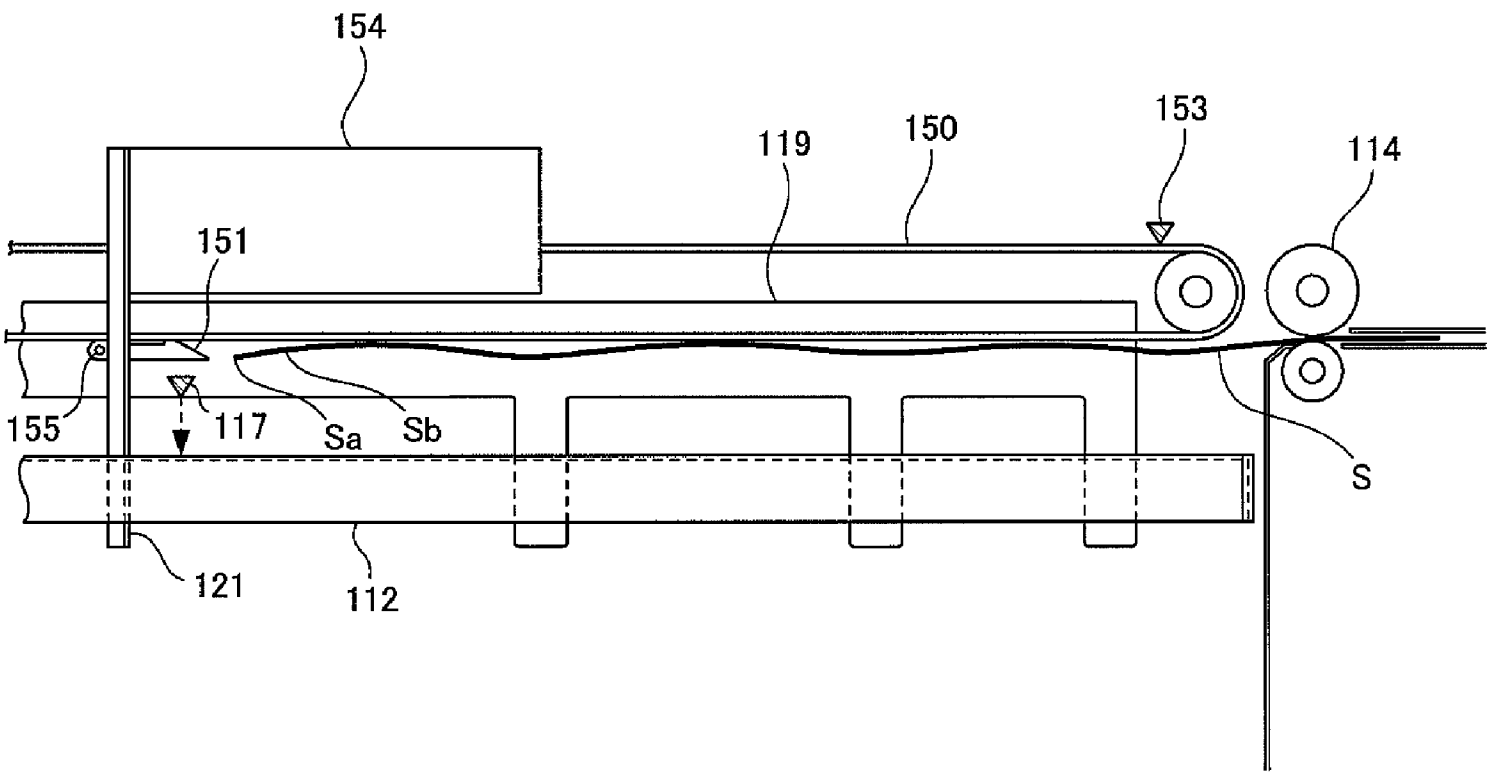
FIG. 10 is a schematic cross-sectional view of a sheet stacking apparatus that is not provided with a sheet pulling unit.

In the above description, there has been described a case where the front end portion of the sheet S is abutted against the stopper 121 by the pulling of the knurled belt 116 of the sheet pulling unit 115 that is movable in the sheet discharging direction as a guide portion, and the guidance of the tapered portion 122. However, only at least one of the knurled belt 116 as a rotating body and the tapered portion 122 as a guide member may be provided. Further, as illustrated in FIG. 10, neither the knurled belt 116 nor the tapered portion 122 may be provided and the front end of the sheet may be abutted against the stopper 121 of a sheet stopper unit 154. In this case, the conveying velocity of the sheet S is sufficiently decreased by the pair of discharge rollers 114 and an inertial force in the discharging direction is applied to the sheet by the pair of discharge rollers 114, so that the sheet is stably and quickly landed and stacked on the stacker tray 112.

Meanwhile, the sheet stopper unit 154 illustrated in FIG. 10 is also guided by a guide member (not illustrated), so that the position of the sheet stopper unit in the sheet discharging direction can be adjusted according to the length of the sheet. The above-mentioned separation point H is set in the vicinity of the upstream side of the guide member in the sheet discharging direction.

When a desired number of sheets are stacked on the stacker tray 112, the stacker control portion 210 of FIG. 3 controls the motor 133 for the stacker tray and lowers the supporting member 136 of FIG. 4 that supports the stacker tray 112 and is lifted and lowered. As the supporting member 136 is lowered, the stacker tray 112 is also lowered. When the supporting member 136 is lowered between supporting surfaces 120*a* and 120*b* of a dolly 120, the stacker tray 112 is placed on the supporting surfaces 120*a* and 120*b*. In this case, the stacker tray 112 is fixed to the dolly 120 by fixing mechanisms such as pins that are provided on the dolly 120.

Figure 11:
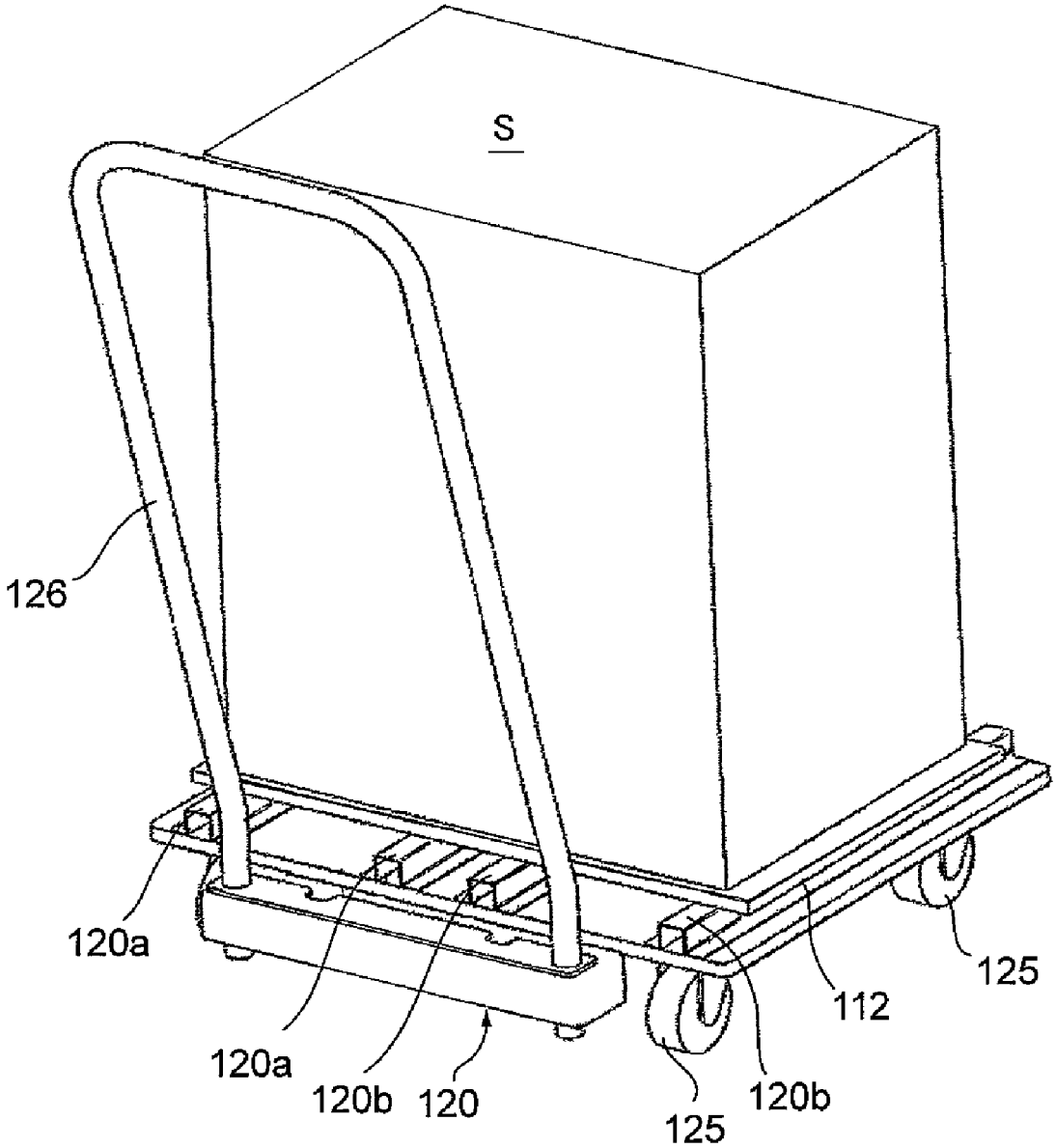
FIG. 11 is a perspective view illustrating the appearance of a dolly on which sheets are stacked.

FIG. 11 is a view illustrating that the stacker tray 112 full of sheets is placed on the dolly 120. The dolly 120 includes four casters 125, and a user can move the dolly by pushing a handle 126. Accordingly, even though the stacker tray 112 is full of sheets, it may be possible to easily take out the sheets from the sheet stacking apparatus by the dolly.

Meanwhile, the stacker tray is one, but may be divided into a plurality of pieces in the sheet discharging direction. In this case, a stacker tray to be used may be selected according to the sheet size, and sheets may be stacked on the selected stacker tray and taken out by the dolly.

The gripper 151 or 152 holds the front end portion of the sheet and the pair of discharge rollers 114 holds the upstream portion of the sheet in the sheet conveying direction as described above so that the sheet is conveyed. In this state, the sheet is conveyed to the vicinity of the separation point H. After that, the stacker control portion 210 controls the motor that drives the pair of discharge rollers 114 and the motor 135 for the timing belt that moves the grippers 151 and 152, and makes the movement velocity of the grippers 151 and 152 be higher than the sheet discharge velocity of the pair of discharge rollers 114. As a result, the front end portion of the sheet is taken out and separated from the gripper. After that, the stacker control portion 210 discharges the sheet, which is separated from the gripper, to the stacker tray 112 by the pair of discharge rollers 114.

As described above, when separating the sheet from the gripper, the stacker takes out the sheet from the gripper by using the difference between the movement velocity of the gripper and the sheet discharge velocity of the pair of discharge rollers. For this reason, the stacker does not need to make the front end portion of the sheet be bumped against the stopper unlike the related art. Accordingly, it may be possible to achieve the following advantages.

The damage to the sheet is decreased. In particular, in the case of a thin sheet, it may be possible to avoid the deformation and damage that are caused by the bump of a sheet against the stopper. Further, even though a sheet is discharged at high velocity from an apparatus main body of an image forming apparatus that is speeded up by the advances in technology, the damage to the sheet is decreased.

In addition, the sound of collision, which has been generated in the related art when the front end portion of the sheet is bumped against the stopper, is not generated. Accordingly, it may be possible to reduce the operating sound of the stacker.

Further, since the timing of separation becomes accurate in comparison with the related art that makes a sheet be bumped against a stopper and separates the sheet from a gripper to take out the sheet from the gripper, it may be possible to keep the stacking position of a sheet constant on the stacking portion and to improve the stack alignment of sheets.

The sheet, which is taken out from the gripper, is stacked on the stacker tray 112 by the pair of discharge rollers 114 without obeying free fall. Accordingly, an inertial force in the sheet discharging direction is applied to the sheet and the sheet is stably and quickly stacked on the stacker tray. For this reason, it may be possible to shorten the fall time of the sheets and to make the fall time of the sheets uniform. As a result, it may be possible to improve the stacking efficiency and stack alignment of sheets.

In addition, since sheets are stacked on the stacker tray 112 by the pair of discharge rollers 114, there is not needed a device for pressing the sheet, which is to be stacked on the stacker tray 112, against the stacker tray 112. Therefore, it may be possible to prevent the structure of the apparatus from being complicated and increased in size.

Further, since the sheet pulling unit 115 is provided, it may be possible to forcibly apply a force component in a falling direction to the sheet by the operation of at least one of the pulling of the knurled belt 116 and the guidance of the tapered portion 122. For this reason, the sheet may be stacked without depending on the fall of the sheet that is caused by the weight of the sheet. As a result, it may be possible to improve the stacking efficiency and stack alignment of sheets.

Since the image forming apparatus 900 includes the sheet stacking apparatus 100 that reduce the damage to a sheet, it is not necessary to form images several times as many as the number of damaged sheets. As a result, it may be possible to improve productivity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-334039, filed Dec. 26, 2008, No. 2009-284854, filed Dec. 16, 2009 which are hereby incorporated by reference herein in their entirety.

What is claimed is:

1. A sheet stacking apparatus comprising:

a discharging portion that discharges a sheet;

a holding portion that moves the sheet downstream in a sheet discharging direction while holding a downstream end portion in the sheet discharging direction of the sheet discharged by the discharging portion;

a stacking portion, located below a movement path of the holding portion, on which the sheet discharged by the discharging portion is stacked; and a control portion that controls at least one of the discharging portion and the holding portion so that a movement velocity of the holding portion is higher than a sheet discharge velocity of the discharging portion when the holding portion is moved a predetermined distance while holding a downstream end portion of the sheet, and separates the sheet nipped by the discharging portion from the holding portion by using a velocity difference between the movement velocity and the sheet discharge velocity.

2. The sheet stacking apparatus according to claim 1, wherein a sheet holding force of the holding portion is set to be smaller than a sheet holding force of the discharging portion.

3. The sheet stacking apparatus according to claim 1, further comprising:

a positioning unit which includes a positioning portion that positions a downstream end of the sheet, which is to be stacked on the stacking portion, in the sheet discharging direction and a guide portion, located in a position where the downstream end of the sheet is reachable, that guides the sheet toward the positioning portion, wherein a position where the sheet is separated from the holding portion is upstream of the guide portion in the sheet discharging direction.

4. The sheet stacking apparatus according to claim 3, wherein the guide portion is an inclined portion that guides the sheet toward the positioning portion.

5. The sheet stacking apparatus according to claim 3, wherein the guide portion is a rotating member that moves the sheet toward the positioning portion.

6. The sheet stacking apparatus according to claim 3, wherein an installation position of the guide portion and the positioning portion in the sheet discharging direction is adjustable depending on a sheet size.

7. The sheet stacking apparatus according to claim 1, further comprising:

a positioning portion that positions a downstream end of the sheet, which is to be stacked on the stacking portion, in the sheet discharging direction, wherein a position where the sheet is separated from the holding portion is upstream of the positioning portion in the sheet discharging direction.

8. An image forming apparatus comprising:

an image forming portion that forms an image on a sheet; and the sheet stacking apparatus according to claim 1 on which the sheet is stacked, the image being formed on the sheet by the image forming portion.

9. An image forming apparatus comprising:

an image forming portion that forms an image on a sheet;

a sheet stacking apparatus on which the sheet is stacked, the image being formed on the sheet by the image forming portion; and a control portion that controls the sheet stacking apparatus, the sheet stacking apparatus including a discharging portion that discharges the sheet;

a holding portion that moves the sheet downstream in a sheet discharging direction while holding a downstream end portion in the sheet discharging direction of the sheet discharged by the discharging portion; and a stacking portion, located below a movement path of the holding portion, on which the sheet is stacked, wherein the control portion controls at least one of the discharging portion and the holding portion so that a movement velocity of the holding portion is higher than a sheet discharge velocity of the discharging portion when the holding portion is moved a predetermined distance while holding a downstream end portion of the sheet, and separates the sheet nipped by the discharging portion from the holding portion by using a velocity difference between the movement velocity and the sheet discharge velocity.

10. The image forming apparatus according to claim 9, the sheet stacking apparatus further including:

a positioning unit which includes a positioning portion that positions a downstream end of the sheet, which is to be stacked on the stacking portion, in the sheet discharging direction and a guide portion, located in a position where the downstream end of the sheet is reachable, that guides the sheet toward the positioning portion, wherein a position where the sheet is separated from the holding portion is upstream of the guide portion in the sheet discharging direction.

11. The image forming apparatus according to claim 10, wherein the guide portion is an inclined portion that guides the sheet toward the positioning portion.

12. The image forming apparatus according to claim 10, wherein the guide portion is a rotating member that moves the sheet toward the positioning portion.

13. The image forming apparatus according to claim 10, wherein an installation position of the guide portion and the positioning portion in the sheet discharging direction is adjustable depending on a sheet size.

14. The image forming apparatus according to claim 9, wherein a sheet holding force of the holding portion is set to be smaller than a sheet holding force of the discharging portion.

15. The image forming apparatus according to claim 9, the sheet stacking apparatus further includes:

a positioning portion that positions a downstream end of the sheet, which is to be stacked on the stacking portion, in the sheet discharging direction, wherein a position where the sheet is separated from the holding portion is upstream of the positioning portion in the sheet discharging direction.

* * * * *